United States Patent [19]

Baker et al.

[11] Patent Number: 4,730,562

[45] Date of Patent: Mar. 15, 1988

[54] VEHICLE TRANSPORTING RAILROAD CAR WITH BRACE BAYS

[75] Inventors: William R. Baker, Lawrenceville, Ga.; James E. Black, Jr., Trenton, Mich.

[73] Assignee: Thrall Car Manufacturing Co., Chicago Heights, Ill.

[21] Appl. No.: 927,860

[22] Filed: Nov. 7, 1986

[51] Int. Cl.[4] ..... B61D 3/18; B61D 17/08

[52] U.S. Cl. ..... 105/407; 410/26; 296/30

[58] Field of Search ..... 105/411, 418, 404, 355, 105/407, 599, 378; 410/26, 27, 24, 4, 3, 2; 296/205, 30, 29, 203; 52/695, 655, 693, 648, 638

[56] References Cited

U.S. PATENT DOCUMENTS

| | | | |
|---|---|---|---|
| 1,074,225 | 9/1913 | Van Dorn | 105/411 X |
| 2,650,443 | 9/1953 | Trumbo | 52/655 |
| 3,017,840 | 1/1962 | Fairweather | 410/26 |
| 3,230,900 | 1/1966 | Ruprecht et al. | 105/411 X |
| 3,426,704 | 2/1969 | Blunden | 105/370 X |
| 4,546,591 | 10/1985 | Beltz | 52/693 X |

*Primary Examiner*—Robert B. Reeves
*Assistant Examiner*—Scott H. Werny
*Attorney, Agent, or Firm*—Marshall, O'Toole, Gerstein, Murray & Bicknell

[57] ABSTRACT

A railroad car for transporting vehicles comprising a car underframe having side sills and supported at each end by a railroad truck; a plurality of spaced apart vertical columns having lower ends rigidly connected to each of the side sills; a first deck supported by the car underframe; a second deck horizontally located above the first deck and rigidly connected to the columns; a brace bay between two adjoining first and second columns near each end of each side of the car; the brace bay having a horizontal member with opposing ends extending between the adjoining columns at the location of the second deck; the brace bay having a first diagonal brace having upper and lower ends extending from the first column downwardly to the second column and a second diagonal brace having upper and lower ends extending from the second column downwardly to the first column, with the upper ends of the two braces being located about at the horizontal member and the lower ends of the two braces being located about at the first deck; a plate connected to the first diagonal brace; the second diagonal brace including 2 sections, each having ends joined to the plate and to the column; a strip overlying and connecting the second diagonal brace ends joined to the plate, and the first diagonal brace; and the horizontal member and the two diagonal braces being largely longitudinal metal tubes which are rectangular in cross-section.

5 Claims, 7 Drawing Figures

50
541
164
56
104
96
110
132
128
92
58
7.
144
150
100
57
130
6.
140
126
106
120
52
142
122
5.
108
90
102
124
94
541
164
56

VEHICLE TRANSPORTING RAILROAD CAR WITH BRACE BAYS

This invention relates to railroad cars used to transport vehicles such as automobiles and trucks, and which are generally referred to as auto rack cars. More particularly, this invention is concerned with a railroad car for transporting vehicles having improved brace bays near the ends of the side walls.

BACKGROUND OF THE INVENTION

Railroad cars are widely used in the United States and other countries to transport vehicles such as automobiles and trucks from manufacturing plants to distribution centers. Such railroad cars are referred to in the trade as auto rack cars.

The railroad cars include a first deck or floor and a pair of side walls which, if desired, support at least one, and often two, elevated decks. Additionally, a roof is generally included to protect the vehicles against damage. The decks carry lined-up tied down vehicles.

Blunden U.S. Pat. No. 3,426,704 discloses a triple deck open topped railroad car for carrying vehicles. Each side of the car has a plurality of vertically positioned horizontally spaced apart columns or uprights which are joined to the car underframe side sills. These columns support the elevated second and third decks. To strengthen the side walls brace bays are located between two adjacent columns near each end of each side of the car. The brace bay shown in the Blunden patent, FIG. 1, has a pair of diagonal braces, arranged to form an X, located between the first or lower deck and the first elevated deck above it. The ends of these braces are effectively joined to the two adjacent columns. No details of the braces is supplied but it is likely they were heavy steel channel members.

Later it was determined that the brace bay system shown in Blunden U.S. Pat. No. 3,426,704 could be advantageously supplemented by installing an additional X-brace system directly above the original one and between the second and third decks. Cars having brace bays with such double X bracing systems have been in commercial use for some years and have performed well. The heavy channel members used for the bracing, however, introduces weight to the car. More importantly, it increases labor and material costs and manufacturing time. A need accordingly exists for a vehicle transporting railroad car with a better brace system which provides the necessary strength yet reduces costs in material, labor and manufacturing.

SUMMARY OF THE INVENTION

A railroad car for transporting vehicles is provided comprising a car underframe having side sills and supported near each end by a railroad truck; a plurality of spaced apart vertical columns having lower ends rigidly connected to each of the side sills; a first deck supported by the car underframe; a second deck horizontally located above the first deck and rigidly connected to the columns; a brace bay between two adjoining first and second columns near each end of each side of the car; the brace bay having a horizontal member with opposing ends extending between the adjoining columns at the location of the second deck; the brace bay having a first diagonal brace having upper and lower ends extending from the first column downwardly to the second column and a second diagonal brace having upper and lower ends extending from the second column downwardly to the first column, with the upper ends of the two braces being located about at the horizontal member and the lower ends of the two braces being located about at the first deck; and the horizontal member and the two diagonal braces being largely longitudinal metal tubes which are rectangular in cross-section.

The ends of the horizontal members and the upper ends of the diagonal members can be joined to plates connected to the columns.

The first diagonal brace can be a continuous length tube and a metal plate can be connected to one side face or surface of the first diagonal brace. The second diagonal brace can include two tube sections, with each tube section having an end joined to the metal plate and the other end extending to the adjacent column. A metal strip desirably overlies and is connected to the tube section ends which are joined to the metal plate. The metal strip can be joined to the first diagonal brace.

The described bracing system not only results in a weight reduction but it contributes to the whole car design in that it has an effect on the underframe, roof eave, deck curb and deck stiffeners. It also reduces the number of pieces and lowers the amount of welding required. Additionally, it eliminates possible obstruction to vehicle doors opening on the second deck during loading and unloading.

DETAILED DESCRIPTION OF THE DRAWINGS

To the extent it is reasonable and practical the same or similar elements or parts in the various views of the drawings will be identified by the same numbers.

Figure 1:
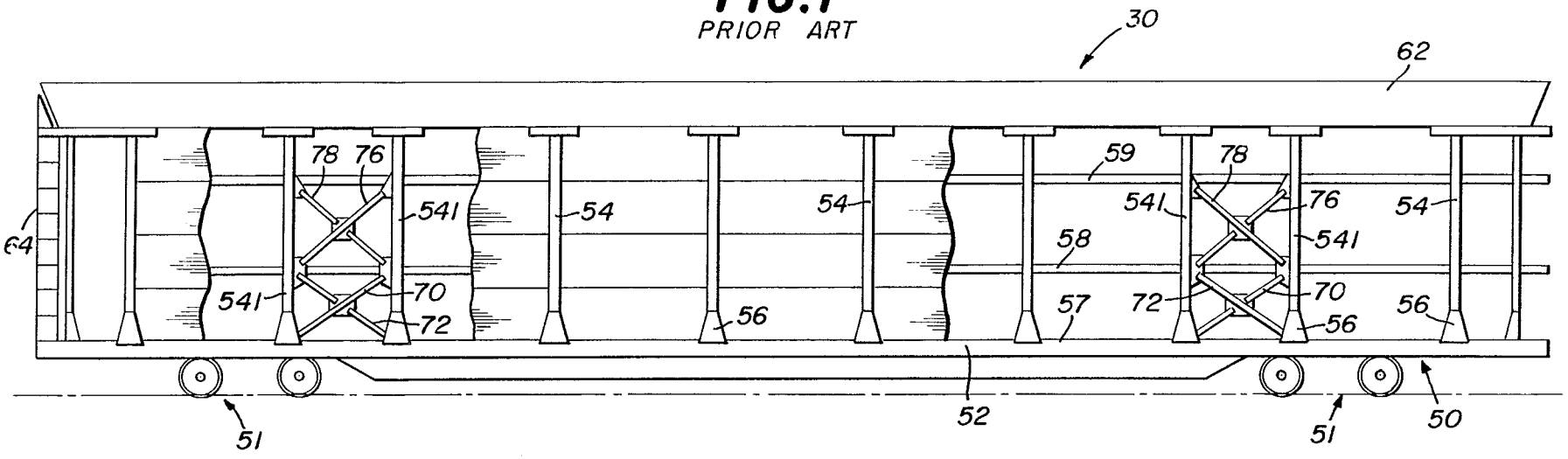
FIG. 1 PRIOR ART
FIG. 1 is a side elevational view of a prior art railroad car used for carrying vehicles.
Figure 2:
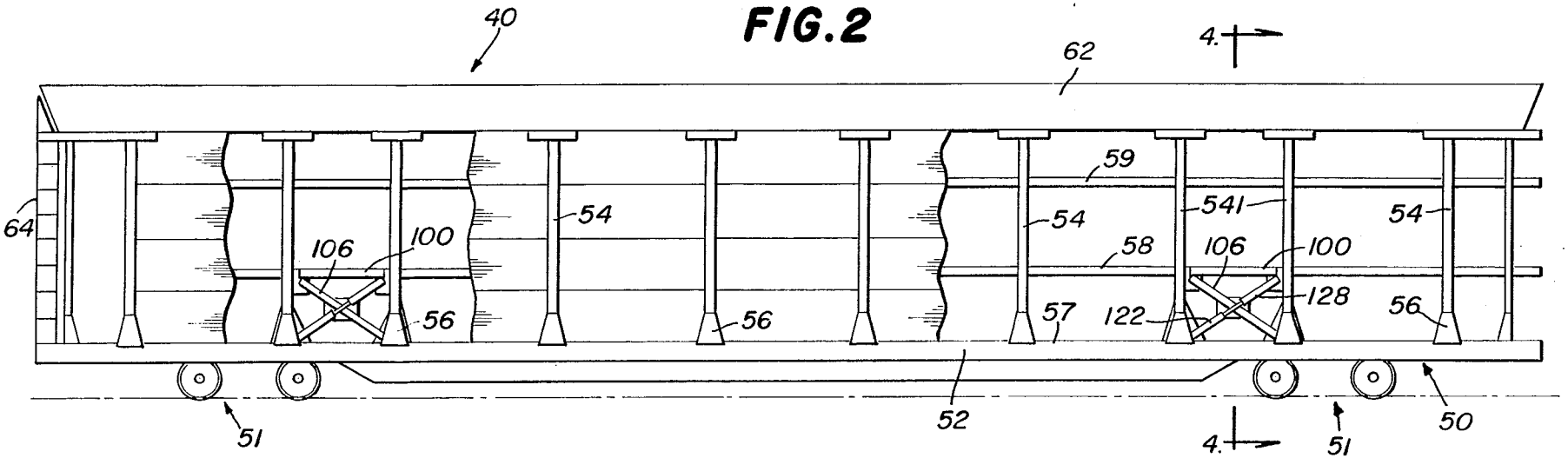
FIG. 2 is a side elevational view of a railroad car according to the invention and which car is similar to the car shown in FIG. 1.

With reference to FIGS. 1 and 2, each of these drawings illustrates vehicle carrying railroad cars which are identical except for the brace bays present in each car. The car of FIG. 1 illustrates a prior art car in commercial use while FIG. 2 illustrates a railroad car according to the invention having brace bays which provide improved strength with less weight at reduced cost.

The prior art auto rack car 30 shown in FIG. 1, and the auto rack car 40 shown in FIG. 2, each have an underframe 50 with longitudinal side sills 52 extending for essentially the length of the car. The underframe 50 is supported by conventional railroad trucks 51 near each end. A plurality of vertical spaced apart columns 54 are located along each car side. The lower ends of the columns 54 are rigidly connected to the side sills 52. A trapezoid-shaped plate 56 is joined to the lower end of each column 54 and the side sill 52 for reinforcement.

The underframe 50 supports a first deck 57. The columns 54 support an elevated second deck 58 above the first deck 57, an elevated third deck 59 above the second deck 58, and a roof 62 at the top of the columns. Each end of the car is provided with a door 64 which can be opened to permit loading and unloading of vehicles and then closed for transport purposes.

Both of the auto rack cars 30,40 shown in FIGS. 1 and 2 have a pair of columns 541, like columns 54, positioned near each end of each side of the car. As shown in FIG. 1, the prior art auto rack car 30 has a brace bay area between each pair of the adjacent columns 541. An X-brace made of channel members 70,72 extends between the two columns 541 and the first and second decks 57,58. An additional X-brace made of channel members 76,78 is located between the two columns 541 and the second and the third decks 58,59. No horizontal beam or other member extending to the two columns is positioned between the two X-braces so that what appears to be such a beam in FIG. 1 is only the side edge of second deck 58.

Figure 3:
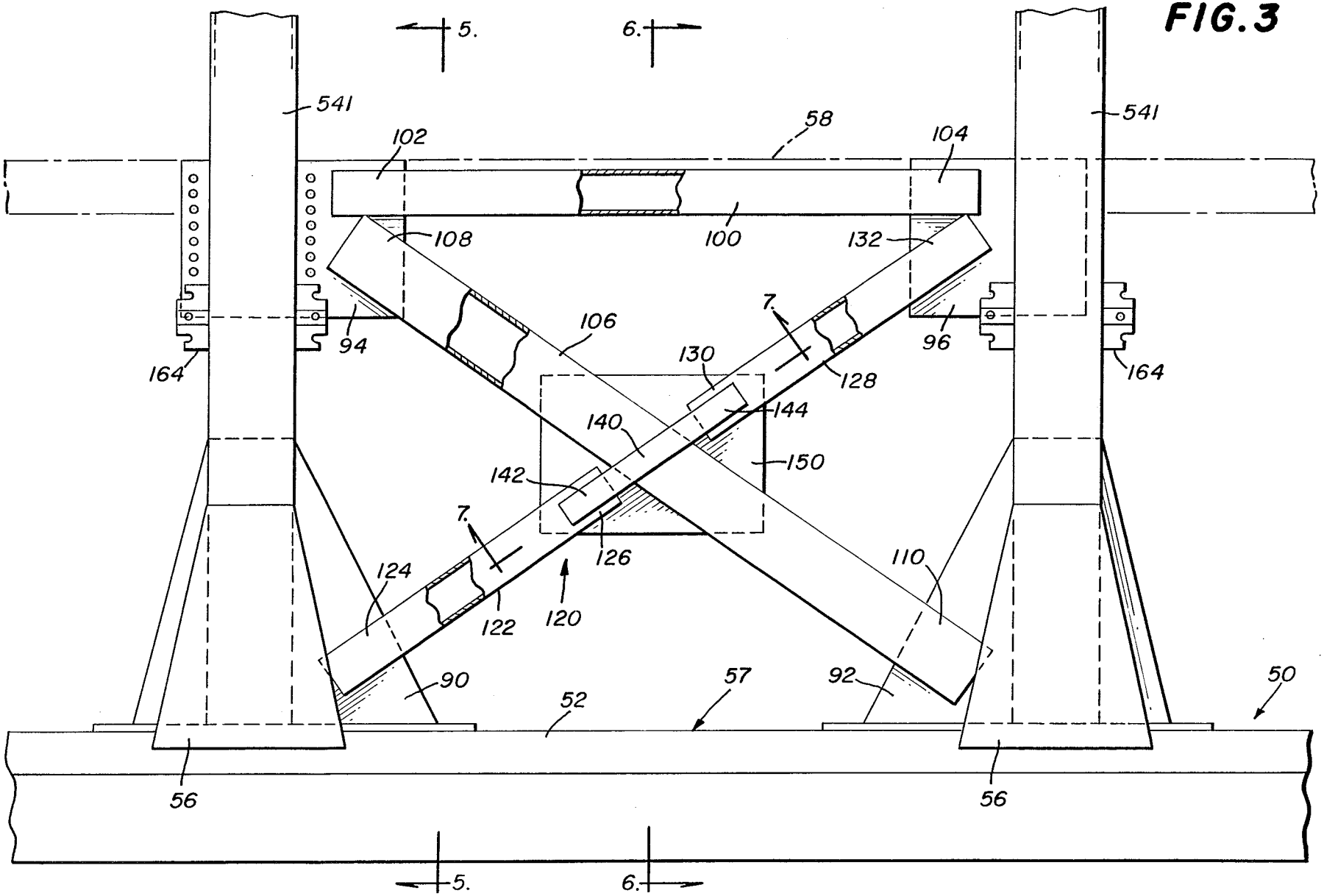
FIG. 3 is an enlarged elevational view of the brace bay area of the railroad car shown in FIG. 2.
Figure 6:
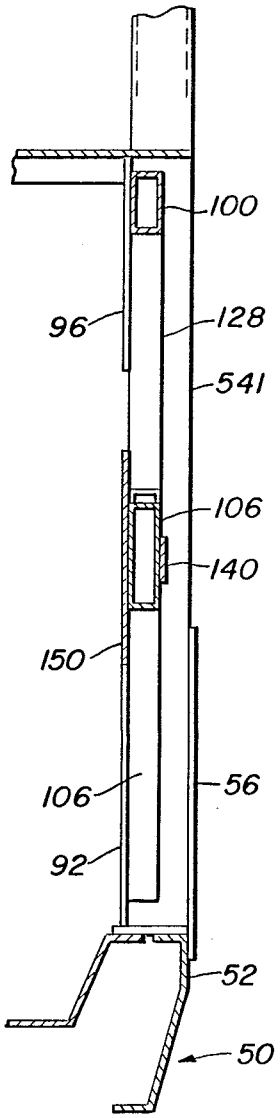
FIG. 6 is a sectional view taken along the line 6—6 of FIG. 3.
Figure 7:
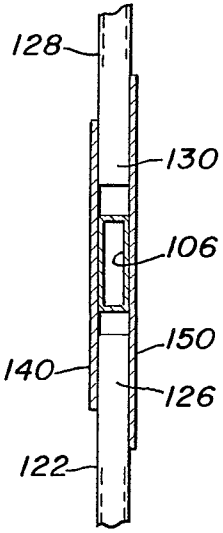
FIG. 7 is a sectional view taken along the line 7—7 of FIG. 3.
Figure 5:
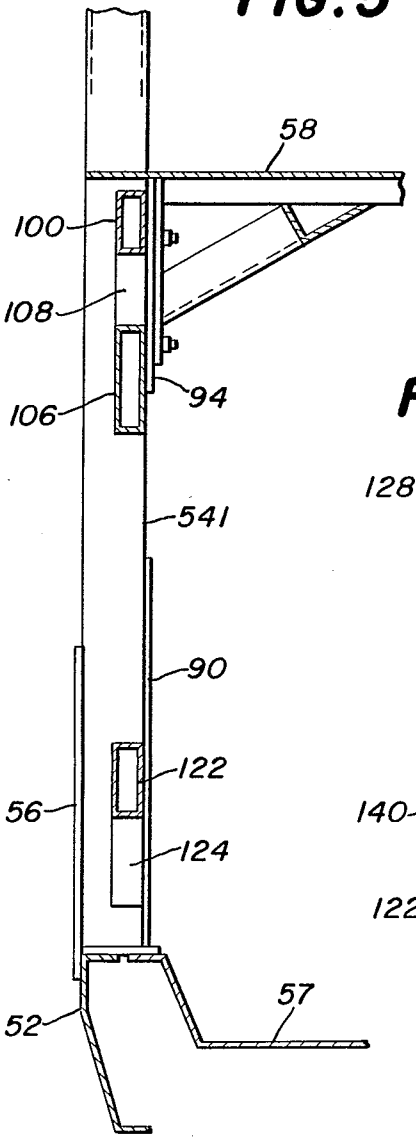
FIG. 5 is a sectional view taken along the line 5—5 of FIG. 3.

The improved brace bay of the invention is illustrated by FIGS. 2 to 6. As shown in FIGS. 2 and 3 the lower ends of columns 541 have trapezoid-shaped plates 90,92 joined to their inside surface. Furthermore, the columns 541 are provided with rectangular metal plates 94,96 in the vicinity of, but located mostly below, the second deck 58.

A horizontal tubular metal beam or member 100 has one end 102 joined to plate 94 and the other end 104 joined to plate 96. The member 100 is rectangular in lateral section.

The upper end 108 of first diagonal metal tubular brace 106 is joined to plate 94 and the lower end 110 of brace 106 is joined to plate 92. Brace 106 is rectangular in lateral section. The second diagonal brace 120 is shown having two rectangular tubular elements 122 and 128. Lower end 124 of element 122 is joined to plate 90 and upper end 126 of element 122 is joined to rectangular plate 150 located in the central inner face area of brace 106. Similarly, the lower end 130 of element 128 is joined to plate 150 and the upper end 132 of element 128 is joined to plate 96. A metal strip 140 is longitudinally positioned on the outer surfaces of elements 122,128 and is joined thereto and to the surface of brace 106.

A brace bay having the described bracing arrangement reduces the total weight of the car by eliminating four upper heavy X-brace systems presently used in three deck vehicle transporting railroad cars. In addition to less material being used, there is a reduction in labor cost and manufacturing time by reducing the number of parts to be fabricated and installed.

Although not part of this invention, FIGS. 3 to 6 illustrate adjustable supports 160 which permit the second and third decks 58,60 to be raised and lowered a total of about three inches in the shop to permit the railroad car to transport vehicles of different heights. Each support 160 has a diagonal brace 162 having its lower end joined to vertical plate 164 and its upper end joined to the deck. The plate 164 is adjustably connected to plates 94,96 by means of bolts. Additional support systems are provided along the car length as required so as to permit height adjustment of the decks.

Figure 4:
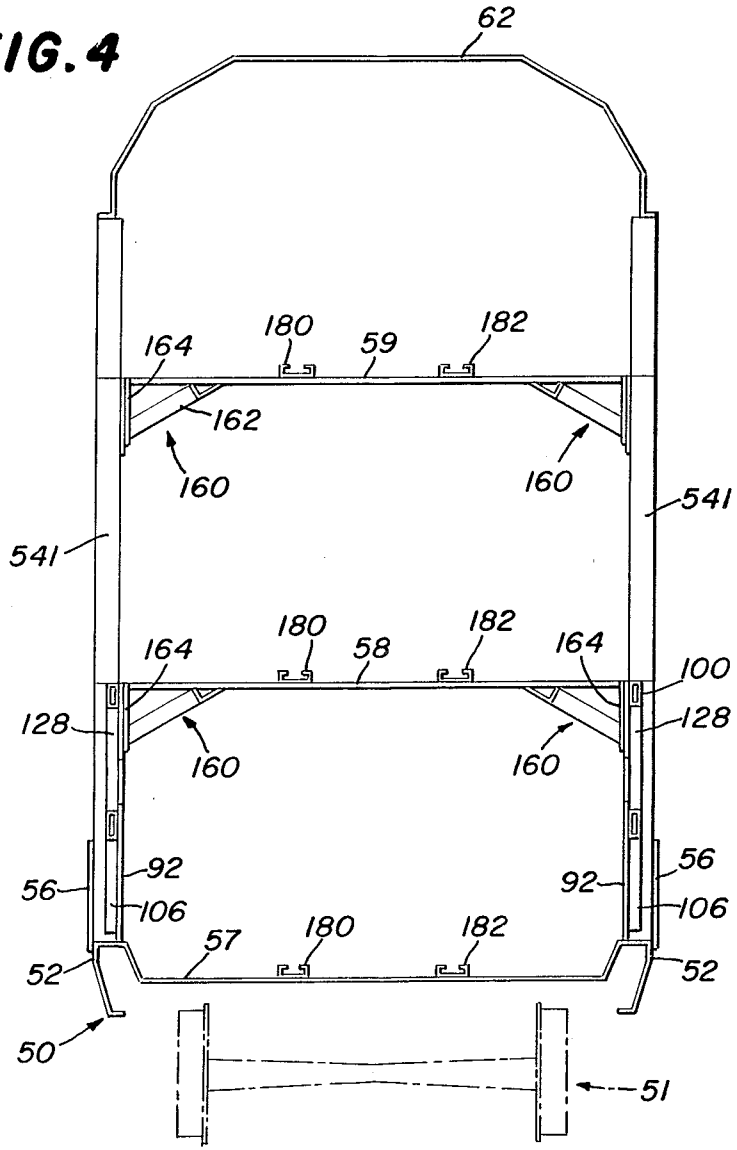
FIG. 4 is a sectional view taken along the line 4—4 of FIG. 2.

It will be seen also in FIG. 4 that each of the decks 50,58,60 is provided with a pair of channel members 180,182 which are used to tie down the vehicles to prevent them from movement during transport. Such channel members are of well known structure in wide use.

The foregoing detailed description has been given for clearness of understanding only, and no unnecessary limitations should be understood therefrom, as modifications will be obvious to those skilled in the art.

What is claimed is:

1. A railroad car for transporting vehicles comprising:

a car underframe having side sills and supported at each end by a railroad truck;

a plurality of spaced apart vertical columns having lower ends rigidly connected to each of the side sills;

a first deck supported by the car underframe;

a second deck horizontally located above the first deck and rigidly connected to the columns;

a brace bay between two adjoining first and second columns near each end of each side of the car;

the brace bay having a horizontal member with opposing ends extending between the adjoining columns at the location of the second deck;

the brace bay having a first diagonal brace in the form of a continuous length tube having upper and lower ends extending from the first column downwardly to the second column;

a metal plate connected to one side face of the first diagonal brace;

a second diagonal brace having upper and lower ends extending from the second column downwardly to the first column, with the upper ends of the two braces being located about at the horizontal member and the lower ends of the two braces being located about at the first deck;

the second diagonal brace including two tube sections, with each tube section having an end joined to the metal plate and the other end extending to the column;

a metal strip overlying and connected to the second diagonal brace tube section ends, which are joined to the metal plate, and the first diagonal brace; and the horizontal member and the two diagonal braces being largely longitudinal metal tubes which are rectangular in cross-section.

2. A railroad car according to claim 1 in which a third deck is supported by the columns above the second deck.

3. A railroad car according to claim 1 in which:

the ends of the horizontal members and the upper ends of the diagonal members are joined to plates connected to the columns.

4. A railroad car for transporting vehicles comprising:

a car underframe having side sills and supported at each end by a railroad truck;

a plurality of spaced apart vertical columns haivng lower ends rigidly connected to each of the side sills;

a first deck supported by the car underframe;

a second deck horizontally located above the first deck and rigidly connected to the columns;

a third deck supported by the columns above the second deck;

a brace bay between two adjoining first and second columns near each end of each side of the car;

the brace bay having a horizontal member with opposing ends extending between the adjoining columns at the location of the second deck;

the brace bay having a first diagonal brace in the from of a continuous length tube having upper and lower ends extending from the first column downwardly to the second column;

a metal plate connected to one side face of the first diagonal brace;

a second diagonal brace having upper and lower ends extending from the second column downwardly to the first column, with the upper ends of the two braces being located about at the horizontal member and the lower ends of the two braces being located about at the first deck;

the second diagonal brace including two tube sections, with each tube section having an end joined to the metal plate and the other end extending to the column;

a metal strip overlying and connected to the second diagonal brace tube section ends, which are joined to the metal plate, and the first diagonal brace; and the horizontal member and the two diagonal braces being largely longitudinal metal tube which are rectangular in cross-section.

5. A railroad car according to claim 4 in which:

the ends of the horizontal members and the upper ends of the diagonal members are joined to plates connected to the columns.

* * * * *

UNITED STATES PATENT AND TRADEMARK OFFICE

CERTIFICATE OF CORRECTION

PATENT NO. : 4,730,562

DATED : March 15, 1988

INVENTOR(S) : William R. Baker et al

It is certified that error appears in the above-identified patent and that said Letters Patent is hereby corrected as shown below:

Column 4, line 56, change "haiving" to -- having --; column 5, line 1, change "from" to -- form --.

Signed and Sealed this

Nineteenth Day of July, 1988

*Attest:*

DONALD J. QUIGG

*Attesting Officer*

*Commissioner of Patents and Trademarks*